United States Patent [19]

Griepentrog et al.

[11] Patent Number: 4,824,323

[45] Date of Patent: Apr. 25, 1989

[54] RADIAL TURBO-MACHINE WITH DISC DIFFUSOR

[75] Inventors: Hartmut Griepentrog, Mülheim; Helmut Beer, Berlin, both of Fed. Rep. of Germany

[73] Assignee: Borsig GmbH, Berlin, Fed. Rep. of Germany

[21] Appl. No.: 164,102

[22] Filed: Mar. 4, 1988

[30] Foreign Application Priority Data

Mar. 5, 1987 [DE] Fed. Rep. of Germany ..... 3707103

[51] Int. Cl.[4] ..... F04D 29/46

[52] U.S. Cl. ..... 415/148; 415/219 A

[58] Field of Search ..... 415/127, 128, 148, 150, 415/146, 219 A

[56] References Cited

U.S. PATENT DOCUMENTS

| | | | |
|---|---|---|---|
| 2,285,976 | 6/1942 | Huitson | 415/128 |
| 3,032,259 | 5/1962 | Jassniker | 415/148 |
| 3,868,196 | 2/1975 | Lown | 415/219 A X |
| 3,941,501 | 3/1976 | Shank | 415/219 A X |

FOREIGN PATENT DOCUMENTS

| | | | |
|---|---|---|---|
| 30288 | 5/1908 | Fed. Rep. of Germany | 415/148 |
| 464970 | 3/1927 | Fed. Rep. of Germany | 415/148 |
| 54-104007 | 8/1979 | Japan | 415/148 |

*Primary Examiner*—Robert E. Garrett
*Assistant Examiner*—Joseph M. Pitko
*Attorney, Agent, or Firm*—Max Fogiel

[57] ABSTRACT

A turbo-operation machine has a rotor disk (2) that rotates in a housing (1) and is surrounded by a disk diffusor. The radial length of the diffusor channel differs locally such that the static pressure at the circumference of the disk diffusor is as uniform as possible.

5 Claims, 2 Drawing Sheets

RADIAL TURBO-MACHINE WITH DISC DIFFUSOR

The invention concerns a turbo-operation machine of radial design in accordance with the preamble to claim 1.

The purpose of the diffusors in turbo-operation machines of radial design is to reduce the flow rate of the medium and convert it into static pressure. Known disk diffusors can have parallel walls or taper conically in or out. The disk diffusors can have guide blades or not. The guide blades can be stationary or adjustable. The known disk diffusors can also be shaped axially to vary certain properties of the turbo-operation machine, to act on the surge limit for example. The disk diffusors, finally, can also be axially adjustable to affect the machine's control behavior.

Rotationally asymmetrical pressure distributions can be produced in the housings of turbo-operation machines of radial design as the result of disruptive objects, local perforations, discontinuities in cross-section, and/or understressed spirals. Known disk diffusors divert the results of this rotationally asymmetrical flow back to the rotor disk. The resulting pressure differences at the circumference affect the operation of the machine, decrease its efficiency, and produce oscillations in the blades of the rotor disk.

The object of the invention is to improve the generic radial turbo-operation machine to the extent that the drawbacks of peripheral pressure differences will be decreased.

This object is attained in accordance with the invention in a generic turbo-operation machine by the characteristics recited in the body of claim 1. Practical embodiments of the invention are recited in the subsidiary claims.

The disk diffusor in accordance with the invention can be adjusted to a low local pressure at the circumference of the disk diffusor such that the locally differentiated radial length of the diffusor channel will increase the pressure at that point. The disk diffussor can also be designed to follow the rotation of the peripheral pressure curve when the operating load changes. The peripheral pressure distribution will accordingly be evened out on the whole downstream of the rotor disk, which will be more uniformly stressed. This evening out of pressure distribution and stress on the rotor disk will improve the efficiency and surge characteristics of the turbo-operation machine. The tendency of the rotordisk blades to vibrate will be decreased by the decreased rotational asymmetries in pressure. The conventional spirals, which are very expensive, can be replaced by simple rotationally symmetrical collection spaced because the aerodynamic drawbacks of such spaces will be compensated.

Figure 1:
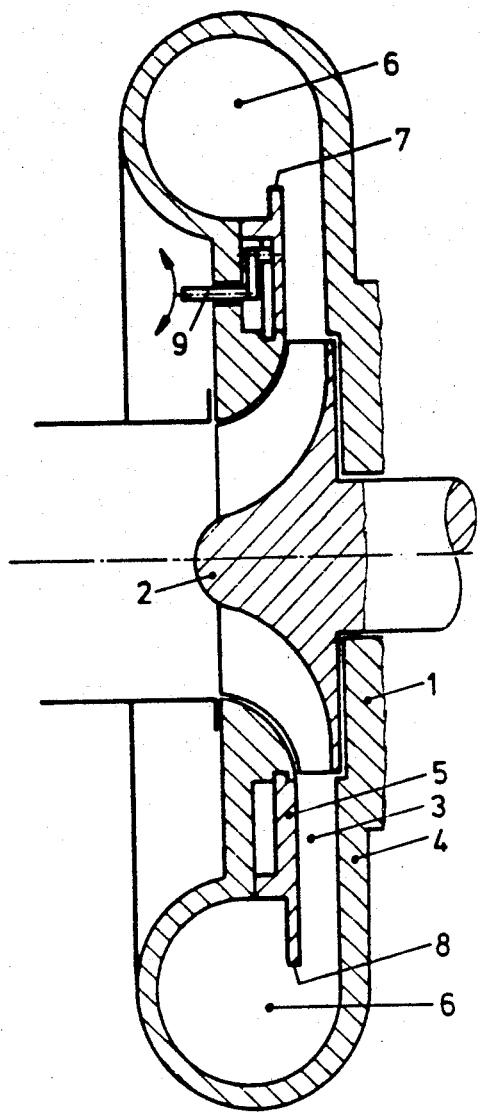
Figure 2:
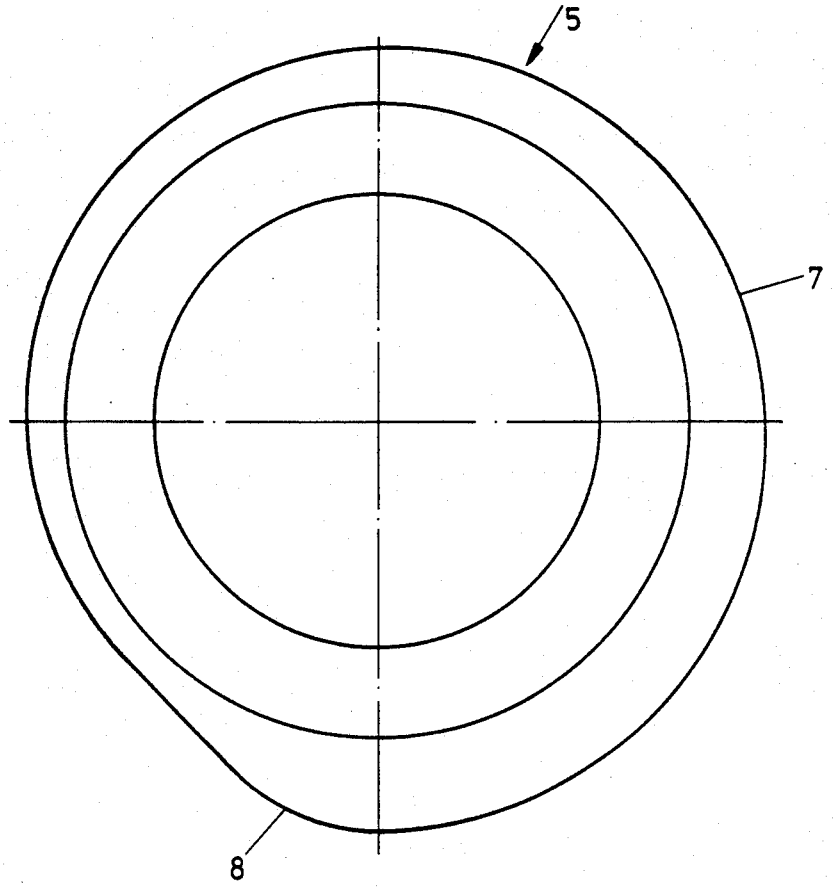

One embodiment of the invention will now be described with reference to the drawing, wherein FIG. 1 is a section through a turbo-operation machine in accordance with the invention and FIG. 2 is a view of one of the disks in the disk diffusor.

A rotor disk 2 rotates in the housing 1, incompletely illustrated, of a turbo-operation machine. Radially above rotor disk 2 is the channel 3 of a disk diffusor, wherein the flow rate of the medium is decreased and converted into static pressure. Diffusor channel 3 consists of the rear wall 4 of housing 1 and of an annular diffusor disk 5. Diffusor channel 3 opens into a collection space 6 inside housing 1. Merging into collection space 6 is an unillustrated connection for extracting the medium. Due to the design of the disk diffusor, which will be described later herein, collection space 6 is preferably rotationally symmetrical and can have a round cross-section. Collection space 6 can taper continuously out toward the extraction connection.

Diffusor disk 5 can rotate inside housing 1 around the axis of rotation of rotor disk 2 and is connected to a system 9 of levers. System 9 of levers can rotate diffusor disk 5 to a certain extent in relation to housing 1.

The radial length of diffusor channel 3 differs locally in size. As will be evident from FIG. 2 in particular, the radially outer edge of diffusor disk 5 is a spiral. The spiral extends inward at one point, resulting in a closed curve 7 with a bulge 8. Since the radially outward edge of the diffusor channel 3 created by rear wall 4 and diffusor disk 5 follows the outer contour of diffusor disk 5, diffussor channel 3 also differs radially in cross-section along its length.

When a local pressure drop results in an irregular peripheral pressure distribution in the turbo-operation machine, diffusor disk 5 will rotate until the point at which the pressure is lower coincides with the bulge 8 in diffusor disk 5. The pressure drop may migrate along the circumference in accordance with the load on the machine. A pressure curve for each point of load can be prescribed along the circumference of the disk diffusor before a new turbooperation machine is operated for the first time. A particular angle of rotation on the part of diffusor disk 5 can be associated with each point of load. It will then be possible to adjust the disk diffusor in accordance with load during operation to obtain the most uniform possible constant distribution of static pressure along the circumference of the disk diffusor.

We claim:

1. A turbo-operation machine of radial design, comprising: a housing: a rotor disk rotating in said housing; said rotor disk having a disk diffusor downstream of said rotor disk; said disk diffusor having a diffusor channel with a radial length differing locally so that the static pressure at the circumference of said disk diffusor is substantially uniform; said disk diffusor rotatable about an axis of rotation of said rotor disk.

2. A turbo-operation machine as defined in claim 1, wherein said disk diffusor is rotatable and has a position depending on the load of said turbo-operation machine.

3. A turbo-operation machine as defined in claim 1, including a wall secured stationary in said housing; an annular rotating diffusor disk bordering said diffusor channel, said diffusor channel being also bordered by said wall secured stationary in said housing.

4. A turbo-operation machine of radial design, comprising: a housing; a rotor disk rotating in said housing; said rotor disk having a disk diffusor downstream of said rotor disk; said disk diffusor having a diffusor channel with a radial length differing locally so that the static pressure at the circumference of said disk diffusor is substantially uniform; said diffusor disk bordering said diffusor channel, said diffusor disk having an adjustable position that can be set and held constant.

5. A turbo-operation machine as defined in claim 4, wherein said housing has a rotationally symmetrical collection space around said disk diffusor.

* * * * *